US005198280A

United States Patent [19]

Harpell et al.

[11] Patent Number: 5,198,280

[45] Date of Patent: Mar. 30, 1993

[54] THREE DIMENSIONAL FIBER STRUCTURES HAVING IMPROVED PENETRATION RESISTANCE

[75] Inventors: Gary A. Harpell; Dusan C. Prevorsek, both of Morristown, N.J.

[73] Assignee: Allied-Signal Inc., Morristown, N.J.

[21] Appl. No.: 603,063

[22] Filed: Oct. 25, 1990

[51] Int. Cl.[5] ..... B32B 3/06

[52] U.S. Cl. ..... 428/102; 428/105; 428/109; 428/113; 428/285; 428/902; 428/911

[58] Field of Search ..... 428/102, 105, 108, 109, 428/113, 911, 902, 285

[56] References Cited

U.S. PATENT DOCUMENTS 4,416,929 11/1983 Krueger ..... 428/102

4,550,045 10/1985 Hutson ..... 428/102

*Primary Examiner*—James J. Bell

*Attorney, Agent, or Firm*—R. C. Stewart, II; G. H. Fuchs; D. L. Webster

[57] ABSTRACT

An improved article of the type comprising one or more flexible fibrous layers wherein the fibers in each layer are arranged parallel or substantially parallel to one another along a common fiber direction with fibers in adjacent layers aligned at an angle with respect to the longitudinal fiber axis of the fibers contained in the layers.

39 Claims, 5 Drawing Sheets

THREE DIMENSIONAL FIBER STRUCTURES HAVING IMPROVED PENETRATION RESISTANCE

BACKGROUND OF THE INVENTION

1. Field of the Invention

This invention relates to articles having improved penetration resistance. More particularly, this invention relates to such articles which are fiber based and which are especially suitable for fabrication into penetration resistant articles such as body armor, as for example, bulletproof vests.

2. Prior Art

Ballistic articles such as bulletproof vests, helmets, structural members of helicopters and other military equipment, vehicle panels, briefcases, raincoats and umbrellas containing high strength fibers are known. Fibers conventionally used include aramid fibers such as poly (phenylenediamine terephthalamide), graphite fibers, nylon fibers, ceramic fibers, glass fibers and the like. For many applications, such as vests or parts of ests, the fibers are used in a woven or knitted fabric. For many of the applications, the fibers are encapsulated or embedded in a matrix material.

U.S. Pat. Nos. 3,971,072 and 3,988,780 relate to light weight armor and method of fabrication of same. Reinforced body armor and the like is fabricated by securing a thin ballistic metal outer shell to a plurality of layers of flexible material having qualities resistant to ballistic penetration. The layers of material are sewn together along paths spaced within a selected predetermined range, so as to restrict movement of the fabric layers in lateral and longitudinal directions and to compact the layers in an elastic mass thereby to provide improved resistance to penetration of the material by a ballistic missile and to reduce back target distortion.

U.S. Pat. No. 4,183,097 relates to a contoured, all-fabric, lightweight, body armor garment for the protection of the torso of a woman against small arms missiles and spall which comprises a contoured front protective armor panel composed of a plurality of superposed layers of ballistically protective plies of fabric made of aramid polymer yarns, the front protective armor panel being contoured by providing overlapping seams joining two side sections to a central section of the panel so as to cause the front protective armor panel to be contoured to the curvature of the bust of a female wearer of the body armor garment to impart good ballistic protection and comfort to the wearer.

U.S. Pat. No. 3,855,632 relates to an undershirt type garment made of soft, absorbent, cotton-like material, stitched thereto and covering the chest and abdomen areas and the back area of the wearer's torso. Inserted between each of the panels and the portions of the shirt which they cover is a pad formed of a number of sheets of closely woven, heavy gage nylon thread. The sheets are stitched together and to the shirt generally along their outer edges so that the major portions of the sheets are generally free of positive securement to each other and thus may flex and move to some extent relative to each other. Thus, the garment, in the padded areas, is substantially bullet-proof and yet is lightweight, flexible, non-bulky and perspiration absorbent.

U.S. Pat. No. 4,522,871 relates to an improved ballistic material comprising a multiplicity of plies of ballistic cloth woven with an aramid, e.g., Kevlar®, thread, one or more of which plies are treated with resorcinol formaldehyde latex to coat the aramid threads and fill the interstices between the threads of a treated ply.

U.S. Pat. No. 4,510,200 relates to material useful in bulletproof clothing is formed from a number of laminates arranged one on top of another. The laminates are preferably formed of a substrate coated with a crushed thermosettable foam that, in turn, covered with a surface film, which may be an acrylic polymer. The films should form the outermost layers of the composite material which together with the foam layer, prevent degradation of the substrate, which is typically formed of fabric woven from Kevlar.

U.S. Pat. No. 4,331,091 describes three-dimensional thick fabrics made from a laminate of fabrics plies held together by yarns looped through holes in the structure. U.S. Pat. No. 4,584,228 describes a bullet-proof garment including several layers of textile fabric or foil superimposed on a shock absorber, in which the shock absorber is a three dimensional fabric with waffle-like surfaces.

U.S. Pat. Nos. 4,623,574; 4,748,064; 4,916,000; 4,403,012; 4,457,985; 4,650,710; 4,681,792; 4,737,401; 4,543,286; 4,563,392; and 4,501,856 described ballistic resistant articles which comprise a fibrous network such as a fabric or 0°/90° uniaxial pregreg in a matrix.

SUMMARY OF THE INVENTION

This invention relates to a penetration resistant article comprising two or more flexible fibrous layers, wherein the fibers in each layer are arranged parallel or substantially parallel to one another along a common fiber direction with at least two adjacent layers aligned at an angle with respect to the common fiber direction of the fibers contained in the layers, at least two of said layers secured together by a securing means extending along at least two adjacent spaced paths.

Another embodiment of this invention relates to a penetration resistant article comprising:

(a) two or more flexible fibrous layers wherein the fibers in each layer are arranged parallel or substantially parallel to one another along a common fiber direction with at least two adjacent layers aligned at an angle with respect to the common fiber direction of fiber axis of the fibers contained in the layers, at least two of said fibrous layers secured together by a securing means extending along at least two parallel spaced paths; and (b) at least one rigid layer which comprises a plurality of rigid bodies arranged with said plurality of flexible fibrous layers.

Yet another embodiment of this invention relates to a penetration resistant article comprising two or more of flexible fibrous layers and affixed thereto wherein the fibers in each layer are arranged parallel or substantially parallel to one another along a common fiber direction with adjacent layers aligned at an angle with respect to the common fiber direction of the fiber contained in the layers, at least two of said fibrous layers being secured together by a plurality of stitches (preferably adjacent and more preferably adjacent, and parallel or substantially parallel and separated by a distance of less than ⅛ in. (0.3175 cm)) comprised of fiber having a tensile modulus equal to or greater than about 20 grams/denier and a tensile strength equal to or greater than about 5 grams/denier.

As used herein, the "penetration resistance" of the article is the resistance to penetration by a designated threat, as for example, a bullet, an ice pick, a knife or the like. The penetration resistance for designated threat can be expressed as the ratio of peak force (F) for a designated threat (projectile, velocity, and other threat parameters known to those of skill in the art to affect the peak force) divided by the areal density (ADT) of the target. As used herein, the "peak force", is the maximum force exerted by a threat to penetrate a designated target using a model 1331 high speed Instron high speed tester having an impact velocity of about 12 Ft/S (3.66 m/S) and where the target strike face area has a diameter of 3 in. (7.6 cm) (See the examples); and as used herein, the "areal density" or "ADT" is the ratio of total target weight to the weight of the target strike face area.

Several advantages flow from this invention. For example, the articles of this invention are relatively flexible, and exhibit relatively improved penetration resistance as compared to other articles of the same construction and composition but having differing securing means. Other advantages include reduced thickness, elimination of wrinkling, better control of component flexibility and better control of panel thickness by precursor composition and tension of the securing means. Still other advantages include reduction in fiber degradation from the weaving process.

BRIEF DESCRIPTION OF THE DRAWINGS

The invention will be more fully understood and further advantages will become apparent when reference is made to the following detailed description of the invention and the accompanying drawings in which.

DETAILED DESCRIPTION OF THE PREFERRED EMBODIMENTS OF THE INVENTION

The preferred embodiments of this invention will be better understood by those of skill in the art by reference to the above figures. The preferred embodiments of this invention illustrated in the figures are not intended to be exhaustive or to limit the invention to the precise form disclosed. They are chosen to describe or to best explain the principles of the invention and its application and practical use to thereby enable others skilled in the art to best utilize the invention.

Figure 1:
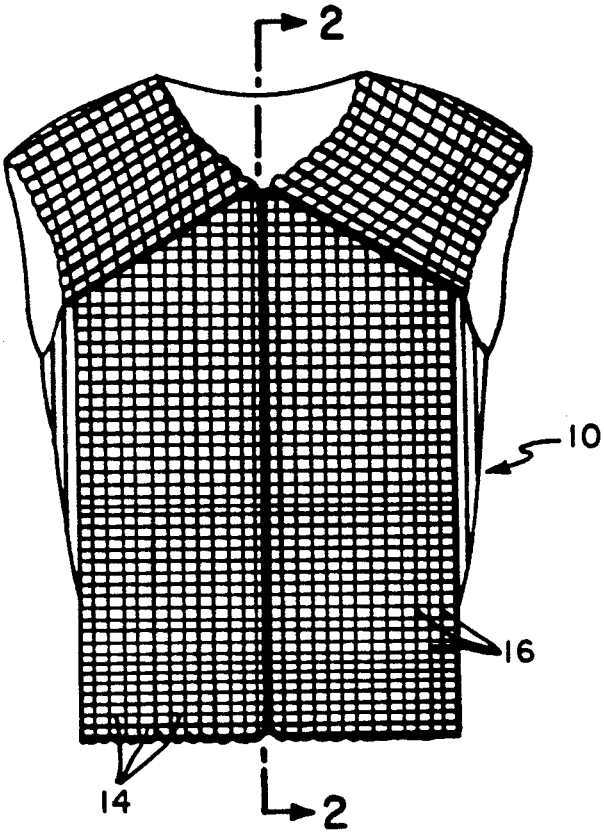
FIG. 1 is a front view of body armor, in the form of a vest, fabricated from reinforced ballistic material in accordance with this invention.
Figure 2:
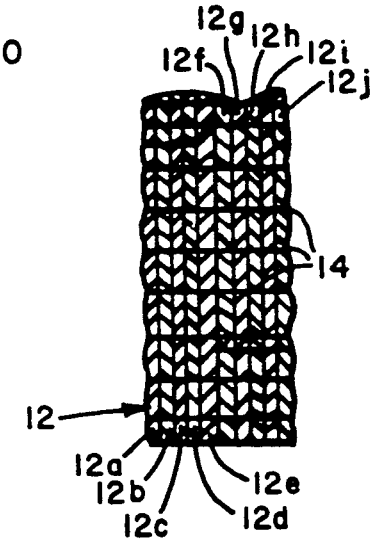
FIG. 2 is an enlarged fragmentary sectional view taken on line 2—2 of FIG. 1 showing a plurality of ballistic resistant fibrous layers with securing means securing the fibrous layers together.

Referring to FIGS. 1 and 2, the numeral 10 indicates a ballistic resistant article 10, which in this preferred embodiment of the invention is penetration resistant body armor which comprises a plurality of fibrous layers 12.

Fibrous layer 12 comprises a network of fibers. For purposes of the present invention, fiber is defined as an elongated body, the length dimension of which is much greater than the dimensions of width and thickness. Accordingly, the term fiber as used herein includes a monofilament elongated body, a multifilament elongated body, ribbon, strip and the like having regular or irregular cross sections. The term fibers includes a plurality of any one or combination of the above.

The cross-section of fibers for use in this invention may vary widely. Useful fibers may have a circular cross-section, oblong cross-section or irregular or regular multi-lobal cross-section having one or more regular or irregular lobes projecting from the linear or longitudinal axis of the fibers. In the particularly preferred embodiments of the invention, the fibers are of substantially circular or oblong cross-section and in the most preferred embodiments are of circular or substantially circular cross-section.

An important feature of this invention is the configuration of the fibers forming fibrous layers 12*a* to 12*j*. It has been found that the beneficial effects of this invention are provided where fibers in at least one and preferably all fibrous layers 12 are aligned in a parallel or substantially parallel and undirectional fashion in a sheet like fiber array, with at least two adjacent fibrous layers 12 aligned at an angle with respect to the longitudinal axis of the fibers contained in said fibrous layers. The angle between adjacent uniaxial layers 12 may vary widely. In the preferred embodiments of the invention, the angle is from about 45° to about 90° and in the most preferred embodiments of the invention is about 90°. For example, one such suitable arrangement is where fibrous layers 12 comprise a plurality of layers or laminates in which the fibers are arranged in a sheet-like array and aligned parallel to one another along a common fiber direction. Successive layers of such uni-directional fibers can be rotated with respect to the previous layer. An example of such laminate structures are composites with the second, third, fourth and fifth layers rotated +45°, −45°, 90° and 0°, with respect to the first layer, but not necessarily in that order. Other examples include composites with 0°/90° layout of yarn or fibers. Techniques for fabricating these laminated structures in a matrix are described in greater detail in U.S. Pat. Nos.

4,916,000; 4,623,574; 4,748,064; 4,457,985 and 4,403,012. The various layers of these laminated structures can be secured together by a suitable securing means as for example sewing. Structures which do not contain a matrix material can be made merely by removal of all or a portion of the matrix material through a conventional technique, as for example solvent extraction, melting, degradation, (oxidation, hydrolysis etc.) and the like. A wide variety of polymeric and non-polymeric matrix materials can be utilized to form the precursor structure to stabilize the fibers in the proper configuration during the procedure for securing the layers together. The only requirement is that the matrix material perform this stabilization function and that it is totally or partially removable from the structure after the securing step by some suitable means.

Fibrous layer 12 may also be formed from fibers coated with a suitable polymer, as for example, polyolefins, vinyl esters, phenolics, allylics, silicones, polyamides, polyesters, polydiene such as a polybutadiene, polyurethanes, and the like provided that the fibers have the required configurations. Fibrous layer 14 may also comprise a network of fibers dispersed in a polymeric matrix as for example a matrix of one or more of the above referenced polymers to form a flexible composite as described in more detail in U.S. Pat. Nos. 4,623,574; 4,748,064; 4,916,000; 4,403,012; 4,457,985; 4,650,710; 4,681,792; 4,737,401; 4,543,286; 4,563,392; and 4,501,856. Regardless of the construction, fibrous layer 14 is such that article 10 has the required degree of flexibility.

The type of fiber used in the fabrication of fibrous layer 12 may vary widely and can be any organic fibers or inorganic fibers. Preferred fibers for use in the practice of this invention are those having a tenacity equal to or greater than about 10 grams/denier (g/d), a tensile modulus equal to or greater than about 150 g/d and an energy-to-break equal to or greater than about 30 joules/grams. The tensile properties are determined on an Instron Tensile Tester by pulling the fiber having a gauge length of 10 in (25.4 cm) clamped in barrel clamps at a rate of 10 in/min (25.4 cm/min). Among these particularly preferred embodiments, most preferred are those embodiments in which the tenacity of the fiber is equal to or greater than about 25 g/d, the tensile modulus is equal to or greater than about 1000 g/d, and the energy-to-break is equal to or greater than about 35 joules/grams. In the practice of this invention, fibers of choice have a tenacity equal to or greater than about 30 g/d, the tensile modulus is equal to or greater than about 1300 g/d and the energy-to-break is equal to or greater than about 40 joules/grams.

The denier of the fiber may vary widely. In general, fiber denier is equal to or less than about 4000. In the preferred embodiments of the invention, fiber denier is from about 10 to about 4000, the more preferred embodiments of the invention fiber denier is from about 10 to about 1000 and in the most preferred embodiments of the invention, fiber denier is from about 10 to about 400.

Useful inorganic fibers include S-glass fibers, E-glass fibers, carbon fibers, boron fibers, alumina fibers, zirconia silica fibers, alumina-silicate fibers and the like.

Illustrative of useful organic fiber are those composed of polyesters, polyolefins, polyetheramides, fluoropolymers, polyethers, celluloses, phenolics, polyesteramides, polyurethanes, epoxies, aminoplastics, polysulfones, polyetherketones, polyetherether-ketones, polyesterimides, polyphenylene sulfides, polyether acryl ketones, poly(amideimides), and polyimides. Illustrative of other useful organic filaments are those composed of aramids (aromatic polyamides), such as Poly(m-xylylene adipamide), poly(p-xylyene sebacamide) poly(2,2,2-trimethyl-hexamethylene terephthalamide) (Kevlar); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl)methylene, terephthalic acid and caprolactam, polyhexamethylene adipamide (nylon 66), poly(butyrolactam) (nylon 4), poly (9-aminonoanoic acid) (nylon 9), poly(enantholactam) (nylon 7), poly(capryllactam) (nylon 8), polycaprolactam (nylon 6), poly (p-phenylene terephthalamide), polyhexamethylene sebacamide (nylon 6,10), polyaminoundecanamide(nylon 11), polydodeconolactam (nylon 12), polyhexamethylene isophthalamide, polyhexamethylene terephthalamide, polycaproamide, poly(nonamethylene azelamide) (nylon 9,9), poly(decamethylene azelamide) (nylon 10,9), poly(decamethylene sebacamide) (nylon 10,10), poly[bis-(4-aminocyclothexyl) methane 1,10-decanedicarboxamide] methane 1,10-decanedicarboxamide] (Qiana) (trans), or combination thereof; and aliphatic, cycloaliphatic and aromatic polyesters such as poly (1,4-cyclohexlidene dimethyl eneterephathalate) cis and trans, poly(ethylene-1 5-naphthalate), poly (ethylene-2, 6-naphthalate), poly (1,4-cyclohexane dimethylene terephthalate) trans, poly (decamethylene terephthalate), poly(ethylene terephthalate), poly(ethylene isophthalate), poly(ethylene oxybenozoate), poly(-para-hydroxy benzoate), poly(dimethylpropiolactone), poly(decamethylene adipate), poly(ethylene succinate), poly(ethylene azelate), poly(decamethylene sebacate), poly-dimethylpropiolactone), and the like.

Also illustrative of useful organic filaments are those of liquid crystalline polymers such as lyotropic liquid crystalline polymers which include polypeptides such as $poly_X$-benzyl L-glutamate and the like; aromatic polyamides such as poly(1,4-benzamide), poly(chloro-1,4-phenylene terephthalamide), poly(1,4-phenylene fumaramide), poly(chloro-1,4-phenylene fumaramide), poly(4,4'-benzanilide trans, trans-muconamide), poly (1,4-phenylene mesaconamide), poly(1,4-phenylene) (trans-1,4-cyclohexylene amide), poly (chloro-1,4-phenylene 2, 5-pyridine amide), poly(3,3'-dimethyl-4, 4'-biphenylene 2, 5 pyridine amide), poly (1,4-phenylene 4, 4'-stilbene amide), poly (chloro-1,4-phenylene 4,4'-stilbene amide), poly(chloro-1, 4-phenylene 4,4'-stilbene amide), poly(1,4-phenylene 4, 4''-azobenzene amide), poly(4,4'-azobenzene 4,4'-azobenzene amide), poly(1,4-phenylene 4,4'-azoxybenzene amide), poly(4,4'-azobenzene 4,4'-azoxybenzene amide), poly(1,4-cyclohexylene 4,4'-azobenzene amide), poly(4,4'-azobenzene terephthal amide), poly(3, 8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,6-naphthal amide), poly(1,5-naphthylene terephthal amide), poly (3,3'-dimethyl-4,4-biphenylene terephthal amide), poly(3,3'-dimethoxy-4,4'-biphenylene terephthal amide), poly(3,3'-dimethoxy-4,4-biphenylene - bibenzo amide) and the like: polyoxamides such as those derived from 2,2' dimethyl-4,4'diamino biphenyl and chloro-1,4-phenylene diamine; polyhydrazides such as poly chloroterephthalic hydrozide, 2,5-pyridine dicarboxylic acid hydrazide) poly(terephthalic hydrazide), poly(terephthalic-chloroterephthalic hydrazide) and the like; poly(amide-hydrazides) such as poly (terephthaloyl 1,4 amino-benzhydrazide) and those prepared from 4-amino-benzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-trans-1,4phenyleneoxyterephthalo yl) in methylene chloride-o-cresol poly(oxy-trans-1,4-cyclohexylene-oxycarbonyl-trans-1,4-cyclohexylenecarbonyl-β-oxy-(2-methyl 1,4-phenylene)oxy-terephthaloyl)] in 1,1,2,2-tetrachloro-ethane-o-cyclohexyleneoxycarbonyltrans-1,4-cyclohexylenecarbonyl-β-oxy(2-methyl-1,3-phenylene)oxy-terephthaloyl] in o-chlorophenol and the like; polyazomethines such as those prepared from 4,4'-diaminobenzanilide and terephthalaldehyde, methyl-1,4-phenylenediamine and terephthalaldehyde and the like; polyisocyanides such as poly(-phenyl ethyl isocyanide), poly(n-octyl isocyanide) and the like; polyisocyanates such as poly (n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisoxazole)(PBO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phneylene)-4-phenylquinoline], poly[1,1'-biphenylene)-6,6'-bis(4-phenylquinoline)] and the like; polyorganophosphazines such as polyphosphazine, polybisphenoxyphosphazine, poly]bis(2,2,2'trifluoroethyelene) phosphazine and the like metal polymers such as those derived by condensation of trans-bis(tri-n-butylphosphine)platinum dichloride with a bisacetylene or trans-bis(tri-n-butylphosphine) bis(1,4-butadinynyl) platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose, thermotropic liquid crystalline polymers such as celluloses and their derivatives as for example hydroxypropyl cellulose, ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers and 6-hydroxy-2-naphthoic acid, terephthalic acid and hyudroquinone, copolymers of 6-hydroxy-2-naphtoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-napthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorophydroquinone, terephthalic acid and ethylene dioxy-4,4'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly(amide-esters).

Also illustrative of useful organic filaments for use in the fabrication of fibrous layer 14 are those composed of extended chain polymers formed by polymerization of α, β- unsaturated monomers of the formula:

$$R_1R_2-C=CH_2$$

wherein:

$R_1$ and $R_2$ are the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. Illustrative of such polymers of α, β- unsaturated monomers are polymers including polystyrene, polyethylene, polypropylene, poly(1-octadecene), polyisobutylene, poly(1-pentene), poly(2-methylstyrene), poly(4-methylstyrene), poly(1-hexene), poly(1-pentene), poly(4-methoxystyrene, poly(5-methyl-1-hexene), poly(4-methylpentene), poly (1-butene), polyvinyl chloride, polybutylene, polyacrylonitrile, poly(-methyl pentene-1), poly(vinyl alcohol), poly(vinyl acetate), poly(vinyl butyral), poly(vinyl chloride), poly(vinylidene chloride), vinyl chloride-vinyl acetate chloride copolymer, poly(vinylidene fluoride), poly(methyl acrylate), poly(methyl methacrylate), poly(methacrylonitrile), poly(acrylamide), poly(vinyl fluoride), poly(vinyl formal), poly (3-methyl-1-butene), poly(1-pentene), poly(4-methyl-1-butene), poly(1-pentene), poly(4-methyl-1-pentene, poly (1-hexane) poly(5-methyl-1-hexene), poly(1-octadecene), poly(vinyl-cyclopentane), poly(vinylcyclothexane), poly(a-vinyl-naphthalene), poly(vinyl methyl ether), poly(vinylethylether), poly(vinyl propylether), poly(vinyl carbazole), poly(vinyl pyrrolidone), poly(2-chlorostyrene), poly(4-chlorostyrene), poly(vinyl formate), poly(vinyl butyl ether), poly(vinyl octyl ether), poly(vinyl methyl ketone), poly(methyl-isopropenyl ketone), poly(4-phenylstyrene) and the like.

In the most preferred embodiments of the invention, composite articles include a filament network, which may include a high molecular weight polyethylene fiber, a high molecular weight polypropylene fiber, an aramid fiber, a high molecular weight polyvinyl alcohol fiber, a liquid crystalline polymer fiber such as liquid crystalline copolyester and mixtures thereof. U.S. Pat. No. 4,457,985 generally discusses such high molecular weight polyethylene and polypropylene fibers, and the disclosure of this patent is hereby incorporated by reference to the extent that it is not inconsistent herewith. In the case of polyethylene, suitable fibers are those of molecular weight of at least 150,000, preferably at least one million and more preferably between two million and five million. Such extended chain polyethylene (ECPE) fibers may be grown in solution as described in U.S. Pat. No. 4,137,394 to Meihuzen et al., or U.S. Pat. No. 4,356,138 issued Oct. 26, 1982, or a fiber spun from a solution to form a gel structure, as described in German Off. 3,004,699 and GB 2051667, and especially described in U.S. Pat. No. 4,551,296 (see EPA 64,167, published Nov. 10, 1982). As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 wt % of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as anti-oxidants, lubricants, ultra-violet screening agents, colorants and the like which are commonly incorporated by reference. Depending upon the formation technique, the draw ratio and temperatures, and other conditions, a variety of properties can be imparted to these filaments. The tenacity of the filaments should be at least 15 grams/denier, preferably at least 20 grams/denier, more preferably at least 25 grams/denier and most preferably at least 30 grams/denier. Similarly, the tensile modulus of the filaments, as measured by an Instron tensile testing machine, is at least 300 grams/denier, preferably at least 500 grams/denier and more preferably at least 1,000 grams/denier and most preferably at least 1,200 grams/denier. All tensile properties are measured by pulling a 10 in. (25.4 cm) fiber length clamped in barrel clamps at a rate of 10 in/min. (25.4 cm/min) on an Instron Tensile Tester. These highest values for tensile modulus and tenacity are generally obtainable only by employing solution grown or gel filament processes.

Similarly, highly oriented polypropylene fibers of molecular weight at least 200,000, preferably at least one million and more preferably at least two million may be used. Such high molecular weight polypropylene may be formed into reasonably well oriented filaments by the techniques prescribed in the various references referred to above, and especially by the technique of U.S. Pat. No. 4,551,296. Since polypropylene is a much less crystalline material than polyethylene and contains pendant methyl groups, tenacity values achievable with polypropylene are generally substantially lower than the corresponding value for polyethylene. Accordingly, a suitable tenacity is at least 8 grams/denier, with a preferred tenacity being at least 11 grams/denier. The tensile modulus for polypropylene is at least 160 grams/denier, preferably at least 200 grams/denier. The particularly preferred ranges for the above-described parameters can advantageously provide improved performance in the final article.

High molecular weight polyvinyl alcohol fibers having high tensile modulus are described in U.S. Pat. No. 4,440,711 to Y. Kwon et al., which is hereby incorporated by reference to the extent it is not inconsistent herewith. In the case of polyvinyl alcohol (PV-OH), PV-OH filament of molecular weight of at least about 200,000.

Particularly useful PV-OH fibers should have a modulus of at least about 300 g/d, a tenacity of at least 7 g/d (preferably at least about 10 g/d, more preferably at about 14 g/d, and most preferably at least about 17 g/d), and an energy-to-break of at least about 8 joules/gram. PV-OH fibers having a weight average molecular weight of at least about 200,000, a tenacity of at least about 10 g/d, a modulus of at least about 300 g/d, and an energy-to-break of about 8 joules/gram are more useful in producing a ballistic resistant article. PV-OH fibers having such properties can be produced, for example, by the process disclosed in U.S. Pat. No. 4,599,267.

In the case of aramid fibers, suitable aramid fibers formed principally from aromatic polyamide are described in U.S. Pat. No. 3,671,542, which is hereby incorporated by reference. Preferred aramid fibers will have a tenacity of at least about 20 g/d, a tensile modulus of at least about 400 g/d and an energy-to-break at least about 8 joules/gram, and particularly preferred aramid fibers will have a tenacity of at least about 20 g/d, a modulus of at least about 480 g/d and an energy-to-break of at least about 20 joules/gram. Most preferred aramid fibers will have a tenacity of at least about 20 g/denier, a modulus of at least about 900 g/denier and an energy-to-break of at least about 30 joules/gram. For example, poly(phenylene terephthalamide) fibers produced commercially by Dupont Corporation under the trade name of Kevlar® 29, 49, 129 and 149 having moderately high moduli and tenacity values are particularly useful in forming ballistic resistant composites. Also useful in the practice of this invention are poly(metaphenylene isophthalamide) fibers produced commercially by Dupont under the trade name Nomex®.

In the case of liquid crystal copolyesters, suitable fibers are disclosed, for example, in U.S. Pat. Nos. 3,975,487; 4,118,372; and 4,161,470, hereby incorporated by reference. Tenacities of about 15 to about 30 g/d and preferably about 20 to about 25 g/d, and modulus of about 500 to 1500 g/d and preferably about 1000 to about 1200 g/d, are particularly desirable.

In addition to uniaxial fibrous layer 12, article 10 may include additional fibrous layers (not depicted). Such layers may be felted, knitted or woven (plain, basket, satin and crow feet weaves, etc.)into a network, fabricated into non-woven fabric, arranged in parallel array, layered, or formed into a woven fabric by any of a variety of conventional techniques. Among these techniques, for ballistic resistance applications we prefer to use those variations commonly employed in the preparation of aramid fabrics for ballistic-resistant articles. For example, the techniques described in U.S. Pat. No. 4,181,768 and in M. R. Silyquist et al., *J. Macromol Sci. Chem.*, A7(1), pp. 203 et. seq. (1973) are particularly suitable.

As depicted in FIG. 2, article 10 is comprised of ten layers 12*a* to 12*j*. However, the number of layers 12 included in article 10 may vary widely, provided that at least two layers are present. In general, the number of layers in any embodiment will vary depending on the degree of ballistic protection and flexibility desired. The number of fibrous preferably from about 5 to about 60 and most preferably from about 20 to about 50.

The ten fibrous layers 12*a* to 12*j* are each secured together by a horizontal securing means 14 and vertical securing means 16, which in the illustrative embodiments of the invention depicted in the figures is stitching. While in the embodiment of the figures all fibrous layers 12*a* to 12*j* are secured together, it is contemplated that the number of layers 12 secured together may be as few as two, or any number of layers 12 in article 10 in any combination. In the preferred embodiments of the invention where the number of layers 12 is more than about 80, all the layers are not secured together. In these embodiments, from about 2 to about 80 layers, preferably from about 2 to about 40 layers, more preferably from about 2 to about 30 layers and most preferably from about 2 to about 20 are secured together forming a plurality of packets (not depicted) with those embodiments in which from about 2 to about 15 layers being secured together being the embodiment of choice. These packets may in turn be secured together by a securing means.

As shown in FIGS. 1 and 2, fibrous layers $12_a$ to $12_j$ are held together by securing means 14 and vertical securing means 16. The distance between securing means 14 and 16 may vary widely. In the preferred embodiments of the invention, the distance between adjacent securing means 14 and 16 is less than about ⅛ in (0.3175 cm). In these preferred embodiments, the lower limit to the spacing between adjacent securing means 14 to 16 is not critical and theoretically such adjacent securing means 14 to 16 can be as close as possible. However, for practical reasons and for convenience, the distance is usually not less than about 1/64 in. (0.40 mm). In the preferred embodiments of the invention, the spacing between securing means 14 and 16 is from about 1/32 in. (0.79 mm) to about 1/10 in. (2.5 mm). More preferred spacings are from about 1/16 in. (1.6 mm) to about 1/10 in. (2.5 mm) and most preferred spacings are from about 1/16 in. (2.5 mm) to about 1/12 in. (2.1 mm).

The distance between the elements of securing means 14 and 16 interconnecting the various fibrous layers may vary widely. Securing means 14 and 16 may be a continuous interconnection of various layers 12 where the path forming means 14 and 16 does not include any region where the various layers 12 are not interconnected. Securing means 14 and 16 may also be discontinuous, in which event the paths forming securing means 14 and 16 are comprised of parts where the various layers 12 are interconnected and other regions where there are no such interconnections. In the embodiment of FIGS. 1 and 2 where the various layers 12 are stitched together, the distance between various elements of securing means 14 and 16 is the stitch length which can vary widely. In the preferred embodiments of the invention the distance between individual securing elements, for example, the stitch length is equal to less than about 6.4 mm. In general, the lower limit may vary widely. More preferred distances are less than about 4 mm more preferred distances are from about 1 to about 4 mm with the distances of choice being from about 2.5 to about 3.5 mm.

In the illustrative embodiment of FIGS. 1 and 2, article 10 has been depicted with two sets of adjacent and substantially parallel horizontal securing means 14 and substantially parallel vertical securing means 16 which are orthogonal with respect to each other intersecting at 90° angles forming a plurality of substantially rectangular or square shaped patterns on the surface of article 10 in which at least two of the paths are separated by a distance of less than about ⅛ in. (0.3175 cm), preferably equal to or about 3.2 mm. This represents the most preferred aspects of the invention. It is contemplated that a single set of paths can be employed. Moreover, the paths need not be parallel and may intersect other than at right angles. The only requirement is that at least two of the paths are adjacent, and that the distance between these adjacent paths is less than about ⅛ in (0.3175 cm).

Layers 12 can be secured and interconnected together by any suitable securing means 14 and 16, so long as at least two of the securing means 14 and 16 interconnecting various layers 12 are within the critical spacing distances discussed adjacent. Illustrative of suitable securing means are stapling, riveting, welding, heat bonding, adhesives, sewing and other means known to those of skill in the art.

In FIGS. 1 and 2, stitches are utilized to form securing means 14 and 16. Stitching and sewing methods such as lock stitching, chain stitching, zig-zag stitching and the like constitute the preferred securing means for use in this invention. The thread used in these preferred embodiments can vary widely, but preferably a relatively high tensile modulus (equal to or greater than about 200 grams/denier) and a relatively high tenacity (equal to or greater than about 15 grams/denier) fiber is used. All tensile properties are evaluated by pulling a 10 in (25.4 cm) fiber length clamped in barrel clamps at a rate of 10 in/min (25.4 cm/min) on an Instron Tensile Tester. In the preferred embodiments of the invention, the tensile modulus is from about 400 to about 3000 grams/denier and the tenacity is from about 20 to about 50 grams/denier, more preferably the tensile modulus is from about 1000 to about 3000 grams/denier and the tenacity is from about 25 to about 50 grams/denier and most preferably the tensile modulus is from about 1500 to about 3000 grams/denier and the tenacity is from about 30 to about 50 grams/denier. Useful threads and fibers may vary widely and will be described in more detail herein below in the discussion of fiber for use in the fabrication of fibrous layers 12. However, the thread or fiber used in the stitches is preferably an aramid fiber or thread (as for example Kevlar® 29, 49, 129 and 149 aramid fibers), an extended chain polyethylene thread or fiber (as for example Spectra® 900 and Spectra® 1000 polyethylene fibers) or a mixture thereof. In the embodiments of the invention depicted in FIGS. 1 and 2, the weight percent of the thread of the stitches having a longitudinal axis perpendicular to the plane of layers 12 is preferably at least about 2% by wgt, more preferably from about 2 to about 30% by wgt. and most preferably from about 4 to about 15% by wgt. All weight percents are based on the total weight of the article.

Figure 3:
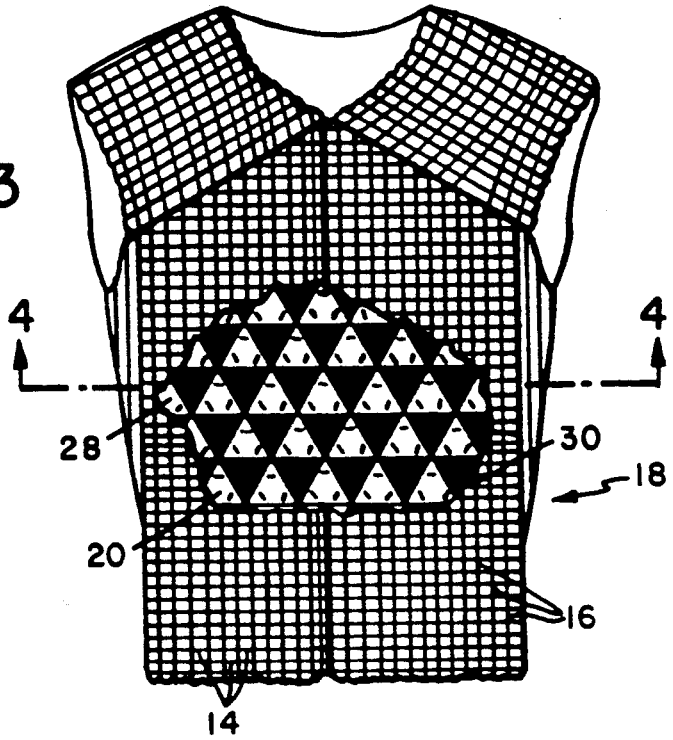
FIG. 3 is a front perspective view of a body armor of this invention having certain selected components cut away for purposes of illustration.
Figure 4:
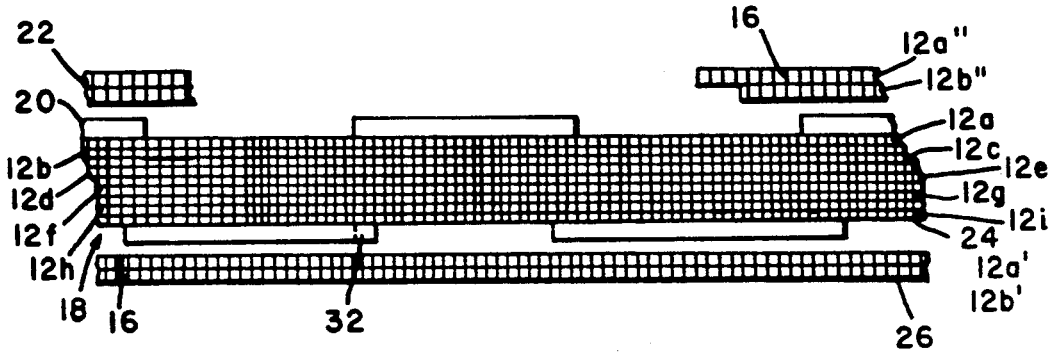
FIG. 4 is an enlarged fragmentary sectional view of the body armor of this invention of FIG. 3 taken on line 4—4 which includes a plurality of rigid ballistic resistant elements on outer surfaces of a plurality of fibrous layers.
Figure 5:
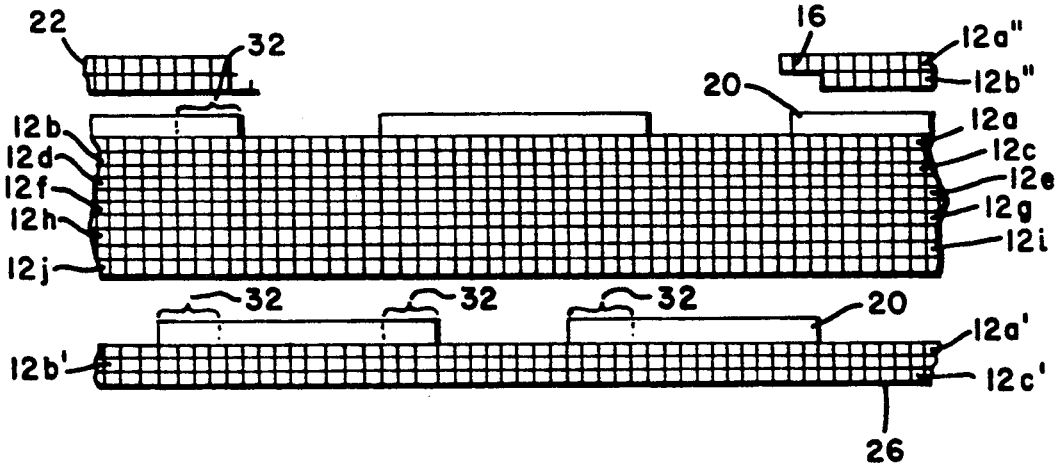
FIG. 5 is an enlarged fragmental sectional view of the body armor of this invention FIG. 3 taken on line 4—4 which includes a plurality of rigid ballistic elements on one side of two fibrous layers.
Figure 6:
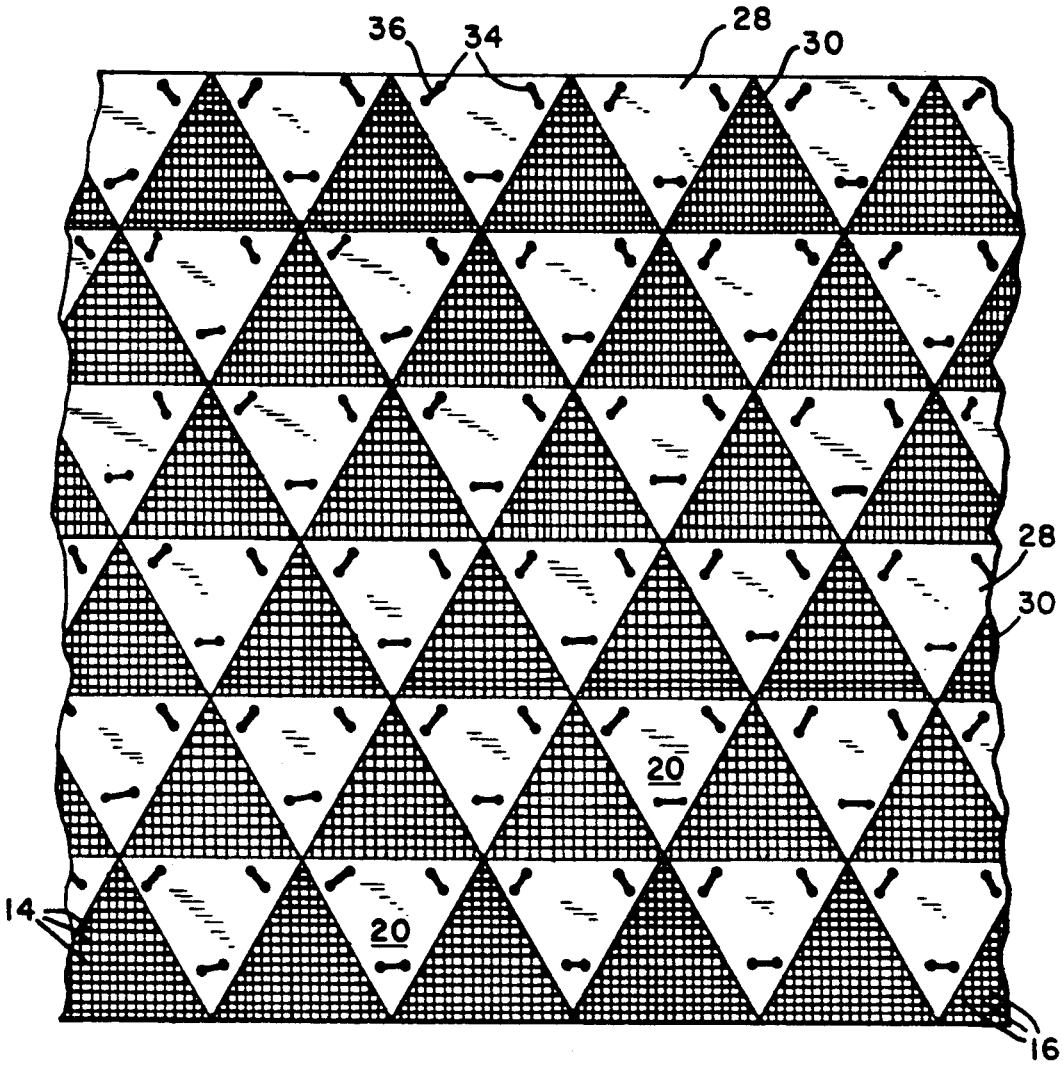
FIG. 6 is a fragmentary frontal view of the body armor of this invention of FIG. 3 in which certain selected layers have been cut away to depict equilateral triangular shaped rigid panels laminated and sewn on both sides of a stitched fabric.

FIGS. 3, 4, 5 and 6 depict fragmentary frontal and cross-sectional views of an article 18 which differs from article 10 of FIGS. 1 and 2 by the addition of a plurality of substantially planar or planar bodies 20 of various geometrical shapes which are affixed to a surface of two or more layers 12 or to both surfaces of a plurality of layers 12 of article 18. As a ballistic missile impacts a planar body 20, the missile can be broken and/or enlarged and flattened to increase its impact area and decrease the velocity of the missile. As depicted in FIG. 3, 5 and 6 in cross-section, article 18 comprises three distinct layers 22, 24 and 26, each consisting of a plurality of fibrous layers 12, stitched together by horizontal stitches 14 and vertical stitches 16 (not depicted). Layer 22 is the outer layer which is exposed to the environment, and layer 26 is the inner layer closest to the body of the wearer. The two covering layers 22 and 26 sandwich a ballistic layer 24, which, in the body armor of the figures comprises a plurality of stitched layers 12 having a plurality of planar bodies 20 partially covering both outer surfaces of said plurality of layers 12 forming a pattern of covered areas 28 and uncovered areas 30 on the outer surfaces. As shown in FIG. 3, the plurality of planar bodies 20 are positioned on the two surfaces such that the covered areas 28 on one surface are aligned with the uncovered areas 30 on the other surface. In the preferred embodiments of the invention depicted in FIG. 3, each planar body 20 is uniformly larger than its corresponding uncovered area 30 such that planar bodies 20 adjacent to an uncovered area 30 partially overlap with the corresponding planar body 20 (of the area 30) on the other outer surface of the plurality of layers 12 by some portion 32. The degree of overlap may vary widely, but in general is such that preferably more than about 90 area %, more preferably more than about 95 area % and most preferably more than about 99 area % of the uncovered areas 30 on an outer surface of the plurality of layers 12 are covered by its corresponding planar body 20 on the other outer surface of the plurality of layers 12.

FIG. 4 depicts a variant of the embodiment of FIG. 3 which differs by placing planar bodies 20 on a surface of layer 26 and on a surface of layer 24. Corresponding parts are referred to by like numerals.

As depicted in the FIGURES, the position of planar bodies 20 can vary widely. For example, planar bodies 20 may be on an outside surface of a fibrous layer 12 or may be encapsulated inside of the plurality of fibrous layers 12 on interior surfaces. As depicted in FIGS. 3 to 6, planar bodies 20 are preferably space filling and will provide more than one continuous or semi-continuous seam, preferably two or three and more preferably three continuous or semi-continuous seams in different directions which preferably intersect at an angle with each other (more preferably at an angle of about 60°) in order to allow flexing in multiple directions.

Figure 7:
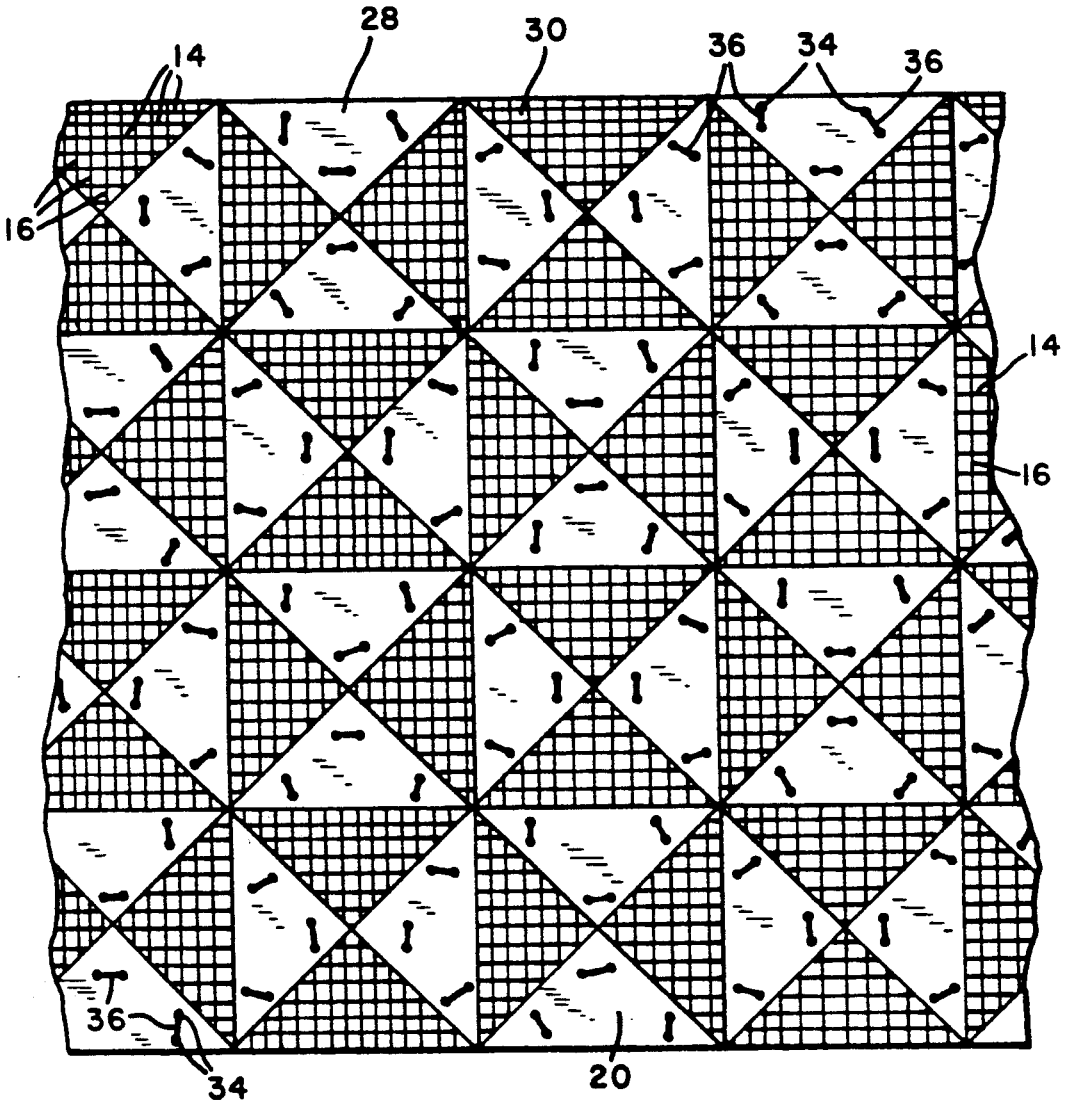
FIG. 7 is a fragmentary frontal view of the body armor of this invention of FIG. 3 in which certain selected layers have been cut away to depict of right angle triangular shaped rigid panels laminated and sewn on both sides of a stitched fabric.
Figure 8:
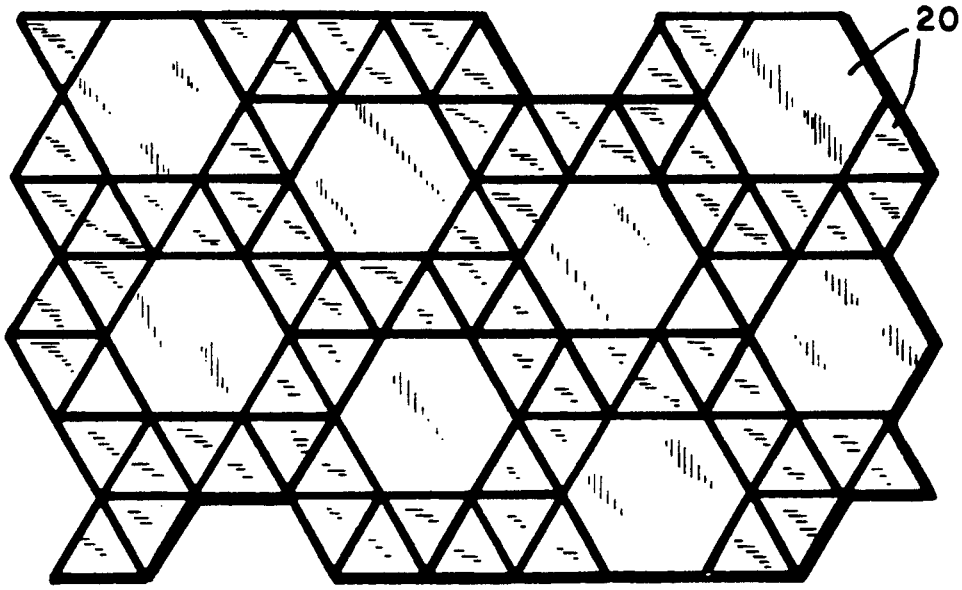
FIG. 8 is a fragmentary frontal view of another embodiment of this invention similar to that of FIG. 3 in which certain selected layers have been cut away to depict shaped rigid panels laminated to one side of the fabric in which the panels are in the shape of equilateral triangles and hexagons.
Figure 9:
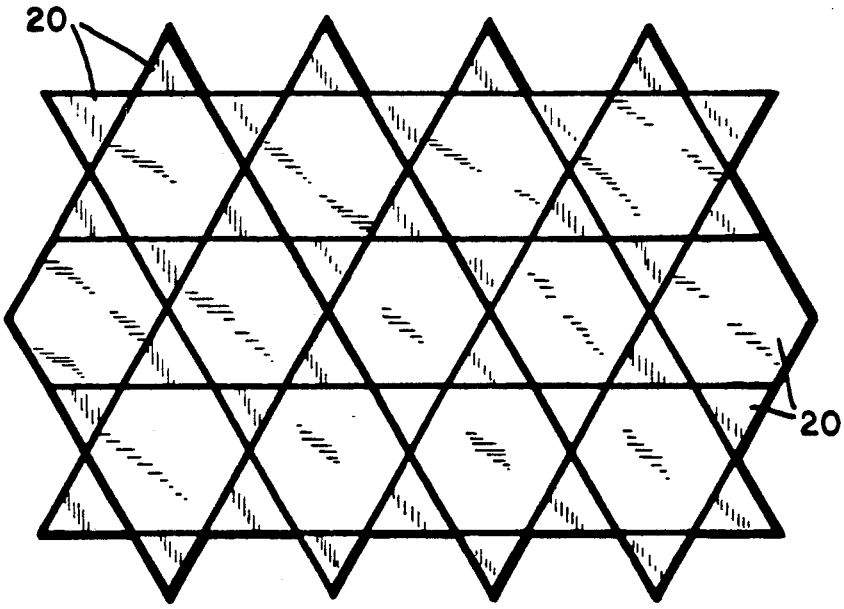
FIG. 9 is a fragmentary frontal view of another embodiment of this invention similar to that of FIG. 3 having shaped rigid panels laminated to one side of the fabric in which the panels are in the shape of equilateral triangles and hexagons.
Figure 10:
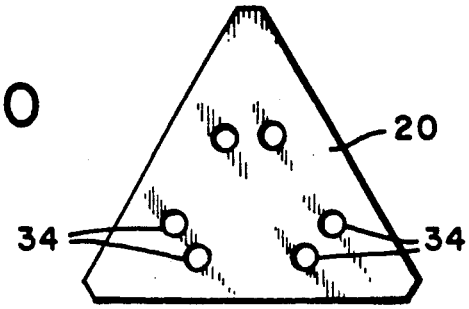
FIG. 10 is a frontal view of a truncated equilateral triangle.

Fixation of planar bodies 20 to a fibrous layer 12 as continuous sheet may cause stiffening of the structure reducing its flexiblity. Although for certain applications this may be acceptable provided that article 10 has the required degree of flexibility, for many applications where relatively high penetration resistance and flexibility are desired, such as a ballistic resistant vest, it is desirable to affix planar bodies 20 to the fibrous layer 12 such that the desired flexibility is obtained. This is preferably accomplished by affixing planar bodies 20 as discontinuous geometric shapes. Preferred geometric shapes will be space filling and will preferably provide substantially continuous seams having three different seam directions to allow flexing in multiple directions, as depicted in FIGS. 5 and 6. A preferred construction consists of planar bodies 20 in the shape of triangles (preferably right and equilateral triangles and more preferably equilateral triangles) which are arranged to be space filling as depicted in FIGS. 5 and 6. A desirable modification to this construction is the inclusion of compatible geometric shapes such as hexagons, parallelograms, trapezoids and the like, which correspond to shapes obtainable by fusion of two or more triangles at appropriate edges. The most preferred compatible shapes are hexagons as depicted in FIGS. 7 and 8. It should be appreciated that while in FIGS. 7 and 8, the hexagonal and triangular shaped bodies are positioned on the same surface of layer 12, such positioning is not critical and bodies 20 can be conveniently placed on more than one surface, as for example in FIGS. 3 to 6. As shown in FIG. 9, in the most preferred embodiments of the invention planar bodies 20 are truncated or rounded at the edges and preferably includes eyes 34 for stitching planar bodies 20 to a surface of layer 12 by way of stitches 36. In these embodiments curvilinear planar bodies 20, such as circular or oval shaped bodies are positioned at the truncated edges to provide additional penetration resistance. Alternatively, a mixture of totally or partially truncated planar bodies 20 and partially truncated or untruncated planar bodies 20 can be used when the various bodies 20 are positioned such that the open spaces at the truncated ends can be covered by the un-truncated ends of the partially truncated or untruncated adjacent planar bodies 20. Flexibility can also be enhanced by having the point of attachment of bodies 20 away from the boundary of the body (See FIGS. 5 and 6). This enhances flexibility by allowing layer 12 to flex away from planar body 20. Additional flexibility can be achieved by providing spacer (not depicted) between layer 12 and planar bodies 20. Such space filling constructions allow a wide range of compromises between flexibility and minimization of seams, and penetration resistance.

An alternative to discontinuous geometric shapes is the use of relatively rigid penetration resistant planar bodies 20 containing slits, perforations and the like. The use of slits, perforations and the like can provide for enhanced ballistic protection while at the same time not affecting the flexibility of the ballistic article to a significant extent. It is desirable that slits, perforations and the like be aligned so that there are, two or three (preferably two or three more preferably three) directions along which planar bodies 20 can easily flex, in an analogous manner to that described previously for the individual geometric shapes.

The position of planar bodies 20 can vary widely. For example, planar bodies 20 may be on an outside surface of a fibrous layer 12 or may be encapsulated inside of the plurality of fibrous layer 12 on an interior surface. As depicted in FIGS. 3 to 6, planar bodies 20 are preferably space filling and will provide more than one continuous seam direction preferably, three or more continuous seams in order to allow flexing in multiple directions.

As shown in FIGS. 3 and 4, in the preferred embodiments of this invention, article 20 includes a plurality of fibrous layers 12 in which rigid substantially planar bodies 20 in adjacent layers 12 are offset to provide for continuous and overlapping rigid ballistic protection. In these embodiments, as shown in FIGS. 4 to 7 article 10 preferably includes at least two layers 12 in which each layer 12 is partially covered with planar bodies 20, preferably forming an alternating pattern of covered areas 28 and uncovered areas 30. These layers are positioned in article 10 such that uncovered areas 30 of one layer 12 are aligned with covered areas 28 of another layer 12 (preferably an adjacent layer) providing for partial or complete coverage of the uncovered areas of one layer 12 by the covered areas of an another layer 12. Alternatively, another preferred embodiment as depicted in FIGS. 3, 4, 5 and 6 includes a layer 12 in which each side of the layer is partially covered with bodies 20 where the bodies are positioned such that the covered areas 28 on one side of the layer are aligned with the uncovered areas 30 on the other side of the layer. In the preferred embodiments of the invention, the surface of layer 12 is covered with planar bodies 20 such that the bodies are uniformly larger than the uncovered mated surface of the other layer 12 or the other surface of the same layer providing for complete overlap. This is preferably accomplished by truncation of the edges of the bodies 20 or otherwise modification of such edges to allow for closest placement of bodies 20 on the surface such that a covered area is larger than the complimentary uncovered area 30. Extensive disalignment between the various fibrous layers 12 is prevented by the securing means 14 and 16.

The shape of planar bodies 20 may vary widely. For example, planar bodies 20 may be of regular shapes such as hexagonal, triangular, square, octagonal, trapezoidal, parallelogram and the like, or may be irregular shaped bodies of any shape or form. In the preferred embodiments of the invention, planar bodies 20 are of regular shape and in the more preferred embodiments of the invention planar bodies 20 are triangular (preferably right or equilateral triangles, more preferably equilateral triangles) shaped bodies or a combination of triangular shaped bodies and hexagonal shaped bodies which provide for relative improved flexibility relative to ballistic articles having planar bodies 20 of other shapes of equal area.

Means for attaching planar bodies 20 to fibrous layer 12 may vary widely and may include any means normally used in the art to provide this function. Illustrative of useful attaching means are adhesive such as those discussed in *R. C. Liable, Ballistic Materials and Penetration Mechanics, Elsevier Scientific Publishing Co.* (1980) as for example bolts, screws, staples, mechanical interlocks, adhesives, stitching and the like or a combination of any of these conventional methods. As depicted in FIGS. 5 and 6 in the preferred embodiments of the invention, planar bodies 20 are stitched to a surface of layer 12 by way of stitches 36 and eyes 34. Optionally, the stitching may be supplemented by adhesives.

Planar bodies 20 are comprised of a rigid ballistic material which may vary widely depending on the uses of article 18. The term "rigid" as used in the present specification and claims is intended to mean free standing and includes semi-flexible and semi-rigid structures that are not capable of being free standing, without collapsing. The materials employed in the fabrication of planar bodies 20 may vary widely and may be metallic or semi-metallic materials, organic materials and/or inorganic materials. Illustrative of such materials are those described in G. S. Brady and H. R. Clauser, *Materials Handbook,* 12th edition (1986).

Materials useful for fabrication of planar bodies include the ceramic materials. Illustrative of useful metal and non-metal ceramic those described in F. F. Liable, *Ballistic Materials and Penetration Mechanics,* Chapters 5-7 (1980) and include single oxides such as aluminum oxide ($Al_2O_3$), barium oxide (BaO), beryllium oxide (BeO), calcium oxide (CaO), cerium oxide ($Ce_2O_3$ and $CeO_2$), chromium oxide ($Cr_2O_3$), dysprosium oxide ($Dy_2O_3$), erbium oxide ($Er_2O_3$), europium oxide: (EuO, $Eu_2O_3$, and $Eu_2O_4$), ($Eu_{16}O_{21}$), gadolinium oxide ($Gd_2O_3$), hafnium oxide ($HfO_2$), holmium oxide ($Ho_2O_3$), lanthanum oxide ($La_2O_3$), lutetium oxide ($Lu_2O_3$), magnesium oxide (MgO), neodymium oxide ($Nd_2O_3$), niobium oxide: (NbO, $Nb_2O_3$, and $NbO_2$), ($Nb_2O_5$), plutonium oxide; (PuO, $Pu_2O_3$, and $PuO_2$), praseodymium oxide: ($PrO_2$, $Pr_6O_{11}$, and $Pr_2O_3$), promethium oxide: $Pm_2O_3$), samarium oxide (SmO and $Sm_2O_3$), scandium oxide ($Sc_2O_3$), silicon dioxide ($SiO_2$), strontium oxide ($S_4O$), tantalum oxide ($Ta_2O_5$), terbium oxide ($Tb_2O_3$ and $Tb_4O_7$), thorium oxide ($ThO_2$), thulium oxide ($Tm_2O_3$), titanium oxide: (TiO, $Ti_2O_3$, $Ti_3O_5$ and $TiO_2$), uranium oxide ($UO_2$, $U_3O_8$ and $Uo_3$), vanadium oxide (VO, $V_2O_3$ $Vo_2$ and $V_2O_5$), ytterbium oxide ($Yb_2O_3$), yttrium oxide ($Y_2O_3$), and zirconium oxide ($ZrO_2$). Useful ceramic materials also include boron carbide, zirconium carbide, beryllium carbide, aluminum beride, aluminum carbide, boron carbide, silicon carbide, aluminum carbide, titanium nitride, boron nitride, titanium carbide titanium diboride, iron carbide, iron nitride, barium titanate, aluminum nitride, titanium niobate, boron carbide, silicon boride, barium titanate, silicon nitride, calcium titanate, tantalum carbide, graphites, tungsten; the ceramic alloys which include cordierite/MAS, lead zirconate titanate/PLZT, alumina-titanium carbide, alumina-zirconia, zirconia-cordierite/ZrMAS; the fiber reinforce ceramics and ceramic alloys; glassy ceramics; as well as other useful materials. Preferred ceramic materials are aluminum oxide, and metal and non-metal nitrides, borides and carbides.

Planar bodies 18 may also be formed from one or more thermoplastic materials, one or more thermosetting materials or mixtures thereof. Useful materials include relatively high modulus (equal to or greater about 6000 psi (41,300 kPa)) polymeric materials such as polyamides as for example aramids, nylon-66, nylon-6 and the like; polyesters such as polyethylene terephthalate, polybutylene terephthalate, and the like; acetalo; polysulfones; polyethersulfones; polyacrylates; acrylonitrile/butadiene/styrene copolymers; poly (amideimide); polycarbonates; polyphenylenesulfides; polyurethanes; polyphenylene oxides; polyester carbonates; polyesterimides; polyimides; polyetheretherketone; epoxy resins; phenolic resins; silicones; polyacrylates; polyacrylics; vinyl ester resins; modified phenolic resins; unsaturated polyester; allylic resins; alkyd resins; melamine and urea resins; polymer alloys and blends of thermoplastics and/or thermosetting resins and interpenetrating polymer networks such as those of polycyanate ester of a polyol such as the dicyanoester of bisphenol-A and a thermoplastic such as polysulfone.

Useful materials for fabrication of planar bodies is also include relatively low modulus polymeric materials (modulus less than about 6000 psi (41,300 kPa) as for example elastomeric materials. Representative examples of suitable elastomers have their structures, properties, formulations together with crosslinking procedures summarized in the Encyclopedia of Polymer Science, Volume 5 in the section Elastomers-Synthetic (John Wiley & Sons Inc., 1964). For example, any of the following materials may be employed: polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride using dioctyl phthate or other plasticers well known in the art, butadiene acrylonitrile elastometers, poly(isobutylene- co-isoprene), polyacrylates, polyesters, polyether, fluoroelastomers, silicone elastomers, thermoplastic elastomers, copolymers of ethylene and a conjugated monomer such as or butadiene and isoprene or a vinyl aromatic monomer such as styrene, vinyl toluene or t-butyl styrene.

These polymeric materials may be reinforced by high strength fibers described above for use in the fabrication of fibrous layer 12, for example, organic fibers such as aramid fibers, polyethylene fibers and mixtures thereof. In addition, the polymeric materials may be reinforced with fibers formed from the inorganic, metallic or semi-metallic materials mentioned above for fabrication of planar bodies 20 such as boron fibers, ceramic fibers, carbon and graphite fibers, glass fibers and the like. In these embodiments of the invention, the fibers are dispersed in a continuous phase of a matrix material which preferably substantially coats each filament contained in the fiber bundle. The manner in which the filaments are dispersed may vary widely. The filaments may have varying configurations of the fibrous network in fibrous layer 12. For example, the filaments may be in the form of woven or non-woven fabrics. The filaments may be aligned in a substantially parallel, undirectional fashion, or filaments may by aligned in a multidirectional fashion, or filaments may be aligned in a multidirectional fashion with filaments at varying angles with each other. In the preferred embodiments of this invention, filaments in each layer are aligned in a substantially parallel, unidirectional fashion such as in a prepreg, pultruded sheet and the like. One such suitable arrangement is where the planar bodies 20 comprise a plurality of layers or laminates in which the coated filaments are arranged in a sheet-like array and aligned parallel to one another along a common filament direction. Successive layers of such coated, uni-directional filaments are rotated with respect to the previous layer. An example of such laminate structures are composites with the second, third, fourth, fifth layers etc. rotated +45°, −45°, 90° and 0°, with respect to the first layer, but not necessarily in that order. Other examples include composites with 0°/90° layout of yarn or filaments. Techniques for fabricating these reinforced laminated structures are described in greater detail in U.S. Pat. Nos. 4,916,000; 4,623,547; 4,748,064; 4,457,985 and 4,403,012.

Useful materials for fabrication of bodies 20 also include metals such as nickel, manganese, tungsten, magnesium, titanium, aluminum and steel plate and the like. Illustrative of useful steels are carbon steels which include mild steels of grades AISI 1005 to AISI 1030, medium-carbon steels or the grades AISI 1030 to AISI 1055, high-carbon steels of the grades AISI 1060 to ISI 1095, free-machining steels, low-temperature carbon steels, rail steel, and superplastic steels; high-speed steels such as tungsten steels, and cobalt steels; hot-die steels; low-alloy steels; low expansion alloys; mold-steel; nitriding steels for example those composed of low-and medium-carbon steels in combination with chromium and aluminum, or nickel, chromium, and aluminum; silicon steel such as transformer steel and silicon-manganese steel; ultrahigh-strength steels such as medium-carbon low alloy steels, chromium-molybdenum steel, chromium-nickel-molybdenum steel, iron-chromium-molybdenum-cobalt steel, quenched-and-tempered steels, cold-worked high-carbon steel; and stainless steels such as iron-chromium alloys austenitic steels, and choromium-nickel austenitic stainless steels, and chromium-manganese steel. Useful materials also include alloys such a manganese alloys, such as manganese aluminum alloy, manganese bronze alloy and the like; nickel alloys such as, nickel bronze, nickel-cast iron alloy, nickel-chromium alloys, nickel-chromium steel alloys, nickel copper alloys, nickel-chromium alloys, nickel-chromium steel alloys, nickel copper alloys, nickel-molybdenum iron alloys, nickel-molybdenum steel alloys, nickel-silver alloys, nickel-steel alloys and the like; iron-chromium-molybdenum-cobalt-steel alloys; magnesium alloys; aluminum alloys such as those of aluminum alloy 1000 series of commercially pure aluminum, aluminum-magnesium-manganese alloys, aluminum-magnesium alloys, aluminum-copper alloys, aluminum-silicon-magnesium alloys of 6000 series, aluminum-copper-chromium of 7000 series, aluminum casting alloys; aluminum brass alloys and aluminum bronze alloys and the like.

Planar bodies 20 may also be formed from a rigid multilayered laminate formed from a plurality of fibrous layers as for example woven or non-woven fabrics, fibrous laminates having 0°/90° configurations and the like. These layers may be consolidated into a body through use of conventional consolidation means such as adhesive, bolts, staples, screws, stitching and the like.

The composites of this invention can be used for conventional purposes. For example, such composites can be used in the fabrication of penetration resistant articles and the like using conventional methods. For example, such penetration resistant articles include meat cutter aprons, protective gloves, boots, tents, fishing gear and the like.

The articles are particularly useful in the fabrication of body armor or penetration resistant articles such as "bulletproof" lining for example, or a raincoat because of the flexibility of the article and its enhanced penetration resistance. The following examples are presented to provide a more complete understanding of the invention and are not to be construed as limitations thereon.

In ballistic studies, the specific weight of the shells and plates can be expressed in terms of the areal density (ADT). This areal density corresponds to the weight per unit are of the ballistic resistant armor. In the case of filament reinforced composites, the ballistic resistance of which depends mostly on filaments, another useful weight characteristic is the filament areal density of the composite. This term corresponds to the weight of the filament reinforcement per unit area of the composite (AD).

EXAMPLE 1

Panels were prepared by stitching 12 SPECTRA-SHIELD® preconsolidated elements (0°/90° panel, 80 wt. % SPECTRA® 1000 fiber, 20 wt. % Kraton® D1107, AD=0.105 kg/m, ADT=0.131 kg/m$^2$). Stitching was carried out on a Singer Industrial Sewing Machine, Model 111W113, using a jig to insure accurately parallel seams. Seams were sewn parallel to fiber directions to form a cross-stitched structure. Samples were immersed in toluene for 24 hours and then removed. This process was repeated two more times and insured that all matrix material was removed from the sample.

The resultant panels were evaluated against various diameter pointed steel probes (included angle of the point was 53 degrees), using a servo hydraulic Instron Tester at impact velocity of 5.3 m/S to evaluate the penetration resistance of the panel. The results of impact testing are shown in TABLE 1. For comparison purposes, a tightly woven fine denier plain weave SPECTRA® 1000 FABRIC was also tested. Comparisons, shown in Table 2, indicate that decreasing the grid size of cross-stitch improves the penetration resistance as the probe diameter decreases.

TABLE 1

| PARAMETER | PANEL A | PANEL B | PANEL C | FABRIC CONTROL |
|---|---|---|---|---|
| PENETRATION RESISTANCE OF SPECTRA® STRUCTURES | | | | |
| STITCH YARN | K-400 | S-580 | S-580 | — |
| AD (kg/m2) | 1.30 | 1.31 | 1.32 | 1.28 |
| ADT (kg/m2) | 1.39 | 1.46 | 1.64 | 1.28 |
| SEAM DISTANCE | | | | |

TABLE 1-continued

| PARAMETER | PANEL A | PANEL B | PANEL C | FABRIC CONTROL |
|---|---|---|---|---|
| (in) | 1/8 | 1/8 | 1/16 | — |
| (mm) | 3.18 | 3.18 | 1.59 | |
| PROBE 1 (0.05 IN./1.27 MM DIAMETER) | | | | |
| F/ADT (N · m²/kg) | 43.9 | 41.5 | 79.2 | 51.2 |
| Ep/ADT (J · m²/kg) | 0.139 | 0.159 | 0.253 | 0.122 |
| Eb/ADT (J · m²/kg) | 0.200 | 0.222 | 0.314 | 0.183 |
| D at Peak | | | | |
| (in) | 0.325 | 0.359 | 0.371 | 0.320 |
| (mm) | 8.26 | 9.12 | 9.42 | 8.13 |
| PROBE 2 (0.07 IN./1.78 MM DIAMETER) | | | | |
| F/ADT (N · m²/kg) | 69.4 | 100 | 148 | — |
| Ep/ADT (J · m²/kg) | 0.22 | 0.41 | 0.73 | — |
| Eb/ADT (J · m²/kg) | 0.28 | 0.55 | 0.85 | — |
| D at Peak | | | | |
| (in) | 0.33 | 0.44 | 0.51 | — |
| (mm) | 8.38 | 11.2 | 13.1 | — |
| PROBE 3 (0.105 IN./2.67 MM DIAMETER) | | | | |
| F/ADT (N · m²/kg) | 371 | 397 | 508 | — |
| Ep/ADT (J · m²/kg) | 2.23 | 2.67 | 3.35 | — |
| Eb/ADT (J · m²/kg) | 2.52 | 3.08 | 3.78 | — |
| D at Peak | | | | |
| in | 0.67 | 0.44 | 0.51 | — |
| (mm) | (17.0) | (18.8) | (19.3) | — |
| PROBE 4 (0.1525 IN./3.87 MM DIAMETER) | | | | |
| F/ADT (N · m²/kg) | 707 | 716 | 867 | — |
| Ep/ADT (J · m²/kg) | 5.47 | 5.36 | 7.13 | — |
| Eb/ADT (J · m²/kg) | 6.45 | 6.14 | 8.54 | — |
| D at Peak | | | | |
| in | 0.877 | 0.877 | 0.97 | — |
| (mm) | (22.3) | (22.3) | (24.6) | |

AD — areal density of parallel fiber webs
ADT — areal density of parallel fiber webs and sewing yarn
K-400 — Kevlar ® 29 sewing yarn, denier 410, modulus 718 g/den., tenacity 19.1 g/den.
S-580 — SPECTRA ® 1000 sewing yarn, denier 581, modulus 900 g/den., tenacity 31.4 g/den.
F — peak force exerted on probe during penetration.
Ep — energy to peak force.
Eb — energy to break.
D — target deflection at peak force.
Fabric control is SPECTRA ® 1000 plain weave fabric 215 denier, 62 × 62 yarns/in. (24.4 × 24.4 yarn/cm).

TABLE 2

RELATIVE PENETRATION RESISTANCE OF FLEXIBLE PANELS SEWN WITH SPECTRA ® 1000 YARN

| PROBE DIAMETER (MM) | RELATIVE PENETRATION RESISTANCE* |
|---|---|
| 1.27 | 1.91 |
| 1.78 | 1.48 |
| 2.67 | 1.28 |
| 3.87 | 1.21 |

*Ratio of F/ADT for 1/16" in (0.1588 cm) seam distance to F/ADT for 1/8" (0.3175 cm) seam distance.
Sewing yarn was S-580.

EXAMPLE 2

Two targets were prepared as follows:

TARGET A: Construction was identical to panel C in Example 1. This target consists of six identical panels. Each panel consists of nine 0°/90° consolidated SPECTRA-SHIELD ® panels which were cross-stitched giving a 1/16 inch (0.1588 cm) grid using a SPECTRA ® 1000, 580 denier sewing yarn. Each of the panels was extracted with toluene solvent to remove the matrix.

TARGET B: This target consists of eight identical panels, each consisting of 6 layers of plain weave SPECTRA ® 1000 fabric (62×62 yarns/in -24.4 yarns/cm, of 215 denier yarn. Sewing yarn was denier SPECTRA ® 1000 sewing yarn. Panels were cross-stitched to form a grid having side dimensions of 1/8 inch (0.3175) length.

TABLE 3

COMPARISON OF WOVEN AND NON-WOVEN SPECTRA 1000 ® TARGETS: PERFORMANCE AGAINST BULLET FRAGMENTS

| TARGET NO. | NO. OF PANELS | WT % STITCHING YARN | AD[1] Kg/m² | ADT[2] kg/m² | V50[3] Ft/Sec. (m/sec) | SEAT J · Kg/m² |
|---|---|---|---|---|---|---|
| A | 6 | 19 | 6.16 | 7.61 | 2063 (629) | 28.6 |
| B | 8 | 12.5 | 6.44 | 7.36 | 2053 (626) | 29.3 |

[1]"AD" is the areal density of the fiber web.
[2]"ADT" is the areal density of the fiber web and the sewing yarn.
[3]"V50" is the projectile velocity at which 50% of the projectiles are stopped.

Ballistic results shown in Table 3 indicate that comparable ballistic results are obtained from the non-woven target compared to a target consisting of conventionally woven fine denier fabric which is stitched together into panels. Weaving of fine denier yarns into fabrics is expensive and causes fiber damage.

EXAMPLE 3

Each panel consists of nine consolidated panels (0°/90°, 80 wt % Kevlar ® 40 fiber, 20 wt % Kraton ® D1107) which were cross-stitched giving a 1/16 inch (1.1588) grid using the designated denier sewing yarn. Each of the panels was extracted with toluene solvent to remove the Kraton ® D1107 matrix. Using the procedure of Example 1, the penetration resistance of each panel was measured. Results of the penetration studies are given in Table 4.

TABLE 4

| STITCH YARN | S-580 | K-400 |
|---|---|---|
| PENETRATION RESISTANCE OF KEVLAR STRUCTURES | | |
| AD (kg/m²) | 1.02 | 1.02 |
| ADT (kg/m²) | 1.25 | 1.18 |
| SEAM DISTANCE | | |
| (in) | 1/16 | 1/16 |
| (mm) | 1.59 | 1.59 |
| PROBE 1 (0.05 IN./1.27 MM DIAMETER) | | |
| F/ADT (N · m/kg) | 147 | 100 |
| Ep/ADT (J · m2/kg) | 0.40 | 0.25 |
| Eb/ADT (J · M2/kg) | 0.48 | 0.25 |
| D at Peak | | |
| (in) | 0.32 | 0.26 |
| (mm) | 8.1 | 6.6 |
| PROBE 2 (0.07 IN./1.78 MM DIAMETER) | | |
| F/ADT (N · m/kg) | 366 | 409 |
| Ep/ADT (J · m2/kg) | 1.92 | 1.94 |
| Eb/ADT (J · M2/kg) | 2.24 | 2.03 |
| D at Peak | | |
| (in) | 0.54 | 0.49 |

TABLE 4-continued

| STITCH YARN | S-580 | K-400 |
|---|---|---|
| (mm) | 13.7 | 12.4 |

AD — real density of parallel fiber webs
ADT — areal density of parallel fiber webs + sewing yarn.
K-400 — Kevlar ® 29 sewing yarn, denier 410, modulus 718 g/den., tenacity 19.1 g/den.
S-580 — SPECTRA ® 1000 sewing yarn, denier 581, modulus 900 g/den., tenacity 31.4 g/den.
F — peak force exerted on probe during penetration
Ep — energy to peak force
Eb — energy to break
D — target deflection at peak force

What is claimed is:

1. An improved penetration resistant layered composite article comprising a plurality of flexible fibrous layers, each of said layers comprising a network of fibers wherein the fibers in each layer are arranged in a fiber array parallel or substantially parallel to one another along a common longitudinal fiber direction in the absence or substantial absence of a polymer matrix material and wherein adjacent layers are positioned such that the common fiber direction in each layer is at an angle with respect to the common fiber direction of the fibers in adjacent layers, and wherein at least two adjacent layers are secured together by a plurality of first fiber stitches extending along all or a portion of at least two adjacent paths wherein the fiber forming said stitches has a tenacity of at least 15 grams/denier and a tensile modulus of at least about 200 grams/denier.

2. The improved article of claim 1 wherein the distance between said first fiber stitches is less than about ⅛ in. (0.3175 cm).

3. The improved article of claim 1 wherein said tenacity is from about 20 to about 50 grams/denier and said tensile modulus is from about 200 to about 3000 grams/-denier.

4. The improved article of claim 3 wherein said tenacity is from about 25 to about 50 grams/denier and said tensile modulus in from about 400 to about 3000 grams/-denier.

5. The improved article of claim 4 wherein said tensile modulus is from about 1000 to about 3000 grams/-denier and said tenacity as from about 30 g/denier to about 50 g/denier.

6. The improved article of claim 3 wherein said modulus is from about 1500 to about 3000 grams/denier.

7. The improved article of claim 2 wherein said fibers forming said stitches are selected from the group consisting of polyethylene fiber, aramid fiber, nylon fiber and combination thereof.

8. The improved article of claim 7 wherein said thread is polyethylene fiber, aramid fiber or a combination thereof.

9. The improved article of claim 7 wherein said angle is from about 45° to about 90°.

10. The improved article of claim 9 wherein said angle is about 90°.

11. The improved article of claim 8 wherein said fiber is polyethylene fiber.

12. The improved article of claim 9 wherein said fiber is aramid fiber.

13. The improved article of claim 8 wherein said fiber is a combination of aramid fiber and polyethylene fiber.

14. The improved article of claim 9 wherein said plurality of first fiber stitches are parallel or substantially parallel.

15. The improved articles of claim 14 which further comprises a plurality of parallel or substantially parallel second stitches wherein the distance between said second stitches is less than about ⅛ in. (0.3175 cm)., said first and second plurality of fiber stitches intersecting at an angle.

16. The improved article of claim 15 wherein said angle is from about 45° to about 90°.

17. The improved article of claim 16 wherein said angle is about 90°.

18. The improved article of claim 14 wherein the distances between said paths is from about 1/64 to less than about ⅛ in. (0.3175 cm).

19. The improved article of claim 18 wherein the distances, between said paths is from about 1/32 to about 1/10 in.

20. The improved article of claim 19 wherein said distance is equal to 1/16 or about 1/10 in.

21. The improved article of claim 20 wherein said distance is from about 1/16 to about 1/12 in.

22. The improved article of claim 14 wherein said stitch length is equal to or less than about 6.4 mm.

23. The improved article of claim 22 wherein said stitch length is equal to or less than about 4 mm.

24. The improved article of claim 23 wherein said stitch length is from about 1 to about 4 mm.

25. The improved article of claim 24 wherein said stitch length is from about 2.5 to about 3.5 mm.

26. An improved article of claim 15 wherein said second plurality of fiber stitches are comprised of fibers having a tensile modulus equal to or greater than about 200 grams/denier and a tenacity equal to or greater than about 15 grams/denier.

27. The improved article of claim 14 wherein said fibrous layers comprising fibers having a tensile strength of at least about 7 grams/denier and an energy-to-break of at least about 30 joules/gram.

28. The improved article of claim 27 wherein fibers have a tenacity equal to or greater than about 20 g/d, a tensile modulus equal to or greater than about 500 g/d and an energy-to-break equal to or greater than about 40 j/g.

29. The improved article of claim 27 wherein said fibers are polyethylene fibers, nylon fibers aramid fibers or a combination thereof.

30. The improved article of claim 29 which further comprises a plurality of rigid bodies arranged with said plurality of fibrous layer.

31. The improved article of claim 29 wherein said fibers are polyethylene fibers.

32. The improved article of claim 29 wherein said fibers are aramid fibers.

33. The improved article of claim 29 wherein said fibers are a combination of polyethylene fibers and aramid fibers.

34. The improved article of claim 30 wherein said rigid bodies are in the shape of triangles or substantially in the shape of triangles or in the shape or substantially in the shape of hexagons and equilateral triangles.

35. The improved article of claim 34 wherein said triangles are right triangles, equilateral triangles or a combination thereof.

36. The improved article of claim 25 wherein said triangles are equilateral triangles.

37. The improved article of claim 30 wherein said rigid bodies are sewn, laminated or laminated and sewn to said fibrous layer.

38. The improved article of claim 30 wherein said rigid bodies are formed from a metal, a ceramic, a polymeric composite comprising a plurality of fibrous layers in a matrix, or a combination thereof.

39. The improved penetration resistant article of claim 1 which is a ballistic resistant article.

* * * * *